US006189179B1

(12) United States Patent
Baird

(10) Patent No.: US 6,189,179 B1
(45) Date of Patent: Feb. 20, 2001

(54) SURFACE DRYING MACHINE

(75) Inventor: Billy Carr Baird, Sturgis, KY (US)

(73) Assignee: Saturn Machine & Welding Co., Inc., Sturgis, KY (US)

( * ) Notice: Under 35 U.S.C. 154(b), the term of this patent shall be extended for 0 days.

(21) Appl. No.: 09/281,030

(22) Filed: Mar. 30, 1999

(51) Int. Cl.[7] ..... E01H 1/02
(52) U.S. Cl. ..... 15/364; 15/401; 15/405
(58) Field of Search ..... 15/346, 364, 405

(56) References Cited

U.S. PATENT DOCUMENTS

| | | | | |
|---|---|---|---|---|
| 1,202,062 | | 10/1916 | Hedley . | |
| 1,283,499 | * | 11/1918 | Gray | 15/364 |
| 2,259,120 | | 10/1941 | Sweeney . | |
| 2,261,006 | | 10/1941 | Sweeney . | |
| 2,312,851 | | 3/1943 | Seibert . | |
| 2,706,863 | | 4/1955 | Jones . | |
| 2,736,567 | | 2/1956 | McMurray . | |
| 2,896,246 | * | 7/1959 | Wildt | 15/405 |
| 2,945,254 | * | 7/1960 | Boissonnault | 15/405 X |
| 3,007,191 | * | 11/1961 | Braun | 15/354 X |
| 3,041,748 | * | 7/1962 | Wetzel | 15/405 X |
| 3,044,193 | | 7/1962 | Zamboni . | |
| 3,284,831 | * | 11/1966 | Larsen | 15/405 X |
| 3,455,041 | | 7/1969 | Roberts . | |
| 3,644,954 | | 2/1972 | LeGrand . | |
| 3,745,700 | | 7/1973 | Hahn . | |
| 3,970,071 | | 7/1976 | Miller et al. . | |
| 4,001,908 | | 1/1977 | Franklin . | |
| 4,204,699 | | 5/1980 | Gustafson . | |
| 4,817,233 | * | 4/1989 | Waldhauser | 15/364 X |
| 4,827,637 | | 5/1989 | Kahlbacher . | |
| 4,951,347 | * | 8/1990 | Star et al. | 15/346 X |
| 5,560,065 | * | 10/1996 | Young | 15/346 X |
| 5,561,921 | | 10/1996 | Vanderlinden . | |

FOREIGN PATENT DOCUMENTS

| | | | | |
|---|---|---|---|---|
| 2405331 | * | 6/1979 | (FR) | 15/346 |

* cited by examiner

*Primary Examiner*—Chris K. Moore
(74) *Attorney, Agent, or Firm*—Wood, Herron & Evans, L.L.P.

(57) ABSTRACT

An apparatus for drying wet roadway surfaces, and more particularly, paved race tracks. The drying device has a rectangular, box-shaped housing with first and second chambers. The first or leading chamber has a first drip pan for collecting water. At least one brush is rotatably mounted in the first chamber such that the longitudinal axis of the brush is oriented transversely to the device's direction of travel when removing water. The brush is adapted to contact the surface so as to collect water in the brush as the brush rotates. The brush is also adapted to contact the first drip pan so as to dislodge the collected water in the brush and deposit the water into the drip pan. First and second squeegees are mounted respectively to the first and second chambers for diverting water away from the surface over which the apparatus is traversing. Finally, a blower is mounted atop the housing for forcing air into the second chamber for evaporating water on the surface not already collected by the brush.

23 Claims, 5 Drawing Sheets

SURFACE DRYING MACHINE

FIELD OF THE INVENTION

The present invention generally relates to apparatus for drying surfaces and, more specifically, to apparatus for drying roadways surfaces such as paved race tracks.

BACKGROUND OF THE INVENTION

Numerous racing events occur outdoors on paved race tracks throughout the year. These racing events take place in various open-air venues including, for example, oval or circular raceways, closed-circuit road courses, and drag strips to name a few. Generally, these racing events are scheduled for a particular day and are planned several months, if not years, in advance. Rescheduling or canceling a race scheduled for a particular day for any reason usually means a big disappointment for the race fans and racing teams as well as being costly to the race organizers.

One common reason to delay or cancel a scheduled race event is unfavorable weather conditions such as falling rain or standing rain water on the race surface. Because most race cars are designed to operate safely only on dry racing surfaces, any water on the racing surface creates a hazardous condition for both the drivers and the fans. Consequently, any water on the racing surface must be removed in a timely fashion for the racing event to safely take place on the scheduled date. Moreover, rapid removal of the water from the racing surface is critical when, for example, a race is stopped and delayed because of falling rain late during the race. If the water cannot be removed promptly after the rain ceases, the remainder of the race may have to be postponed to another day or canceled altogether.

Different techniques and machines have been used to remove water from racing surfaces all with varying degrees of success. One technique uses a train of vehicles such as pick-up trucks to parade around the race track to promote evaporation of the water. This technique is crude and costly, requiring numerous vehicles and operators and achieving only limited drying effectiveness.

In addition to the truck parade technique, various drying machines have been designed to dry racing surfaces. These drying machines can be either self-propelled units or adapted to be towed behind another vehicle. One drying machine may blow heated air alone onto the racing surface to promote evaporation. Another drying machine may use a rotating brush to sweep the water off the surface and into a collection tank. Still another drying machine may incorporate squeegees that direct the water to one side of the racing surface. While these drying machines do assist in the removal of water from the racing surface, their drying effectiveness is still insufficient to guarantee a quick restart of a race delayed by water on the racing surface.

It would be desirable, therefore, to have a surface drying machine which greatly shortens the time for removing water from a racing surface. This drying machine would be simple and inexpensive to operate, allowing a rain delayed race to continue shortly after the rain has stopped falling.

SUMMARY OF THE INVENTION

The invention is generally directed to apparatus for drying wet surfaces, and more particularly, roadway surfaces such as paved race tracks. While the drying machine is especially adapted to operate on paved race tracks, the drying machine could be readily used on other hard surfaces such as airport runways, highways, and outdoor tennis and basketball courts. The drying device has a rectangular, box-shaped housing with first and second chambers. The first chamber has a first drip pan for collecting water. The first chamber precedes the second chamber as the device traverses the surface when removing the water. At least one brush is rotatably mounted in the first chamber such that the longitudinal axis of the brush is oriented transversely to the device's direction of travel when removing water. The brush is adapted to contact the surface so as to collect water in the brush as the brush rotates. The brush is also adapted to deposit the water into the drip pan. First and second squeegees are mounted respectively to the first and second chambers for diverting water away from the surface over which the apparatus is traversing. Finally, a blower is mounted atop the housing for forcing air into the second chamber to aid evaporation of water on the surface not already collected by the brush.

As the drying device travels over a wet surface the first squeegee diverts excess water to one side of the device. This excess diverted water may be handled by either a second drying device or the same drying device making a pass adjacent to the initial pass. Water not diverted by the first squeegee is swept up by the rotating brush within the first chamber. The brush collects the water and strikes or contacts the drip pan which dislodges the water from the brush and into the drip pan. After being subjected to a squeegee and the rotating brush, the surface is substantially free of standing water, though a thin layer of water may still remain. To aid in removing this remaining layer of water from the surface, i.e., dry the surface, the blower forces heated air into the second chamber which has an open bottom. The heated air promotes evaporation of the remaining layer of water to leave an essentially dry surface. Finally, the second squeegee is affixed to the trailing edge of the second chamber to again divert any possible remaining water on the surface to one side of the drying device. As such, the combination of the squeegees, the brush, and the blower enable the drying device to quickly and efficiently remove water from surfaces, and especially, roadway surfaces such as paved race tracks.

Advantageously, a first pair of oppositely disposed wheels are operatively connected to the housing and work in cooperation with an operation hitch which is operatively connected to the housing such that the drying device may be pulled by a vehicle in a direction perpendicular to the longitudinal axis of the brush so as to remove water from the surface. In one configuration, the first pair of wheels are operatively coupled to the brush so as to turn the brush when the first pair of wheels turn. In another configuration, however, a hydraulically actuated motor is operably coupled to the brush so as to turn the brush even when the first pair of wheels is not turning. Additionally, a second set of wheels are operatively connected to the housing and oriented perpendicularly to the first set of wheels. The second set of wheels work in cooperation with a transport hitch which is detachably connected to the housing such that the apparatus may be towed by a vehicle in a direction parallel to the longitudinal axis of the brush when the device is not being used to remove water from the surface.

Alternatively, a transport hitch is pivotally connected to the housing so that the housing can be selectively rotated relative to the transport hitch such that the water removal apparatus can be towed in one of two orientations. The first orientation is parallel to the longitudinal axis of the brush. The second orientation is perpendicular to the longitudinal axis of the brush. This particular transport hitch has a pair of transport wheels, preferably steerable, disposed at one end of the transport hitch and a coupling device disposed at the other, or opposite, end of the transport hitch. In addition, the transport hitch includes a lift cylinder for lifting the housing and the wheels attached to the housing so that the housing can be selectively rotated between the first and second towing orientations.

In a preferred embodiment of the drying device two brushes are mounted for rotation within the first chamber. These brushes are aligned along a common longitudinal axis and are mounted in floating bearings such that each brush may follow the contours of the surface so as to maintain contact with the surface when removing water.

Advantageously, the first chamber additionally includes second and third drip pans which are adapted to collect water made air born by the rotation of the brush. That is, not only does the rotation of the brush cause water to be collected in the brush for deposit in the first drip pan, but it also causes water to be propelled into the air ahead of the advancing brush. The second and third drip pans are situated so as to collect this air born water which does not lodge within the brush. Advantageously, a collection tank is attached to the housing and is adapted to receive the water collected by each of the three drip pans.

As a further preferred feature, the first and second chambers share a common wall. The wall has slots for diverting a portion of the air from the blower into the first chamber to help evaporate the air born water and the water remaining in the brush. Advantageously, the common wall has a third squeegee mounted to divert additional water away from the surface which was not removed by the first squeegee and the rotating brush.

The drying device of the present invention, therefore, can remove water from a roadway surface quickly and efficiently by utilizing a combination of drying devices. Specifically, the squeegees, the rotating brush, and the blower work together to effectively remove water from a roadway surface, such as a paved race track, in a relatively short period of time.

Various additional advantages, objects and features of the invention will become more readily apparent to those of ordinary skill in the art upon consideration of the following detailed description of the presently preferred embodiment taken in conjunction with the accompanying drawings.

DETAILED DESCRIPTION OF THE DRAWINGS

DETAILED DESCRIPTION OF A PREFERRED EMBODIMENT

Figure 1:
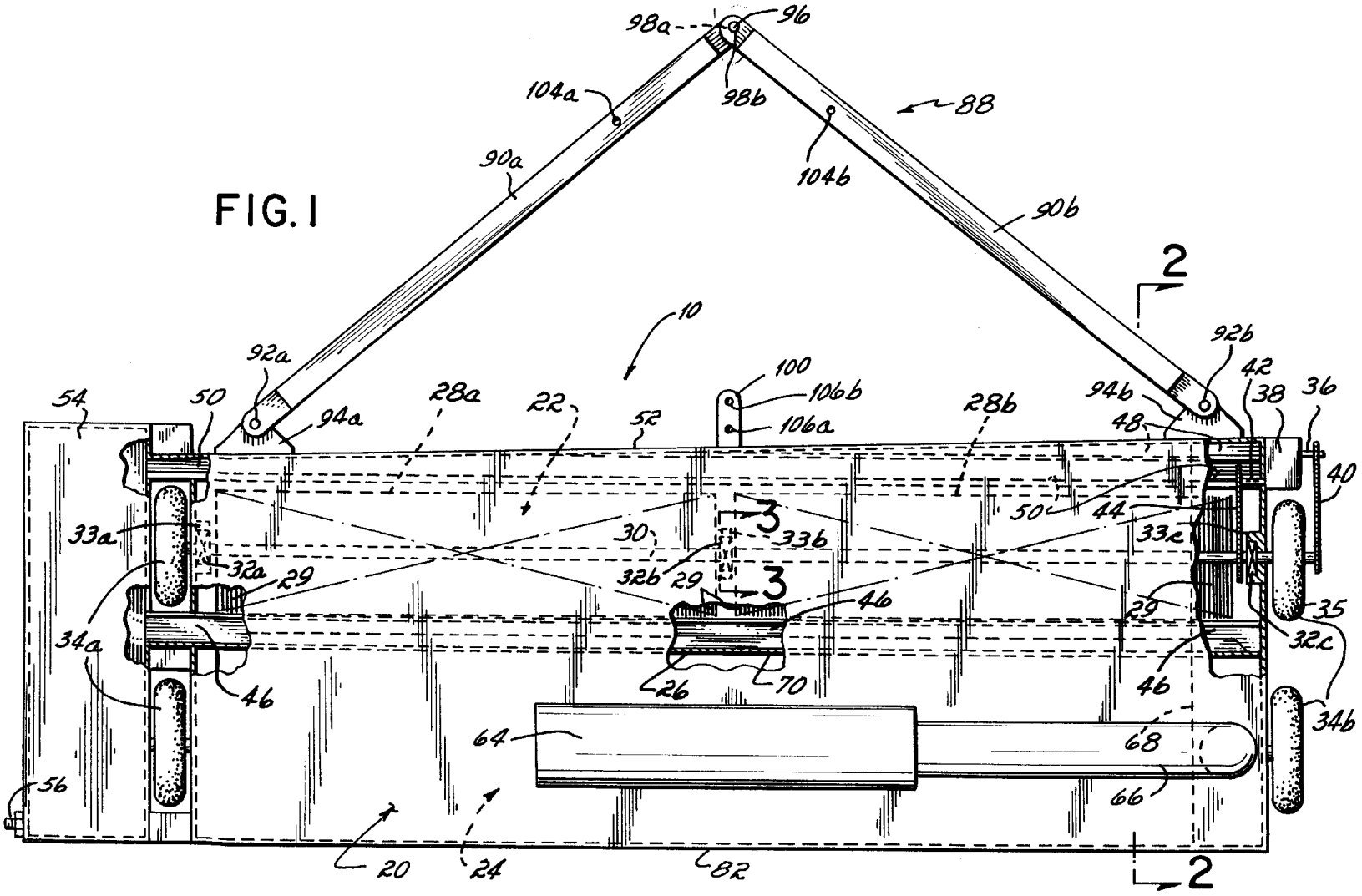
FIG. 1 is a elevational view of a surface drying machine of the invention.
Figure 4:
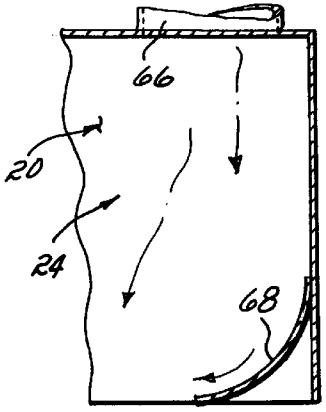
FIG. 4 is an enlarged partial cross-sectional view of the surface drying machine of FIG. 1 taken along line 4—4.
Figure 2:
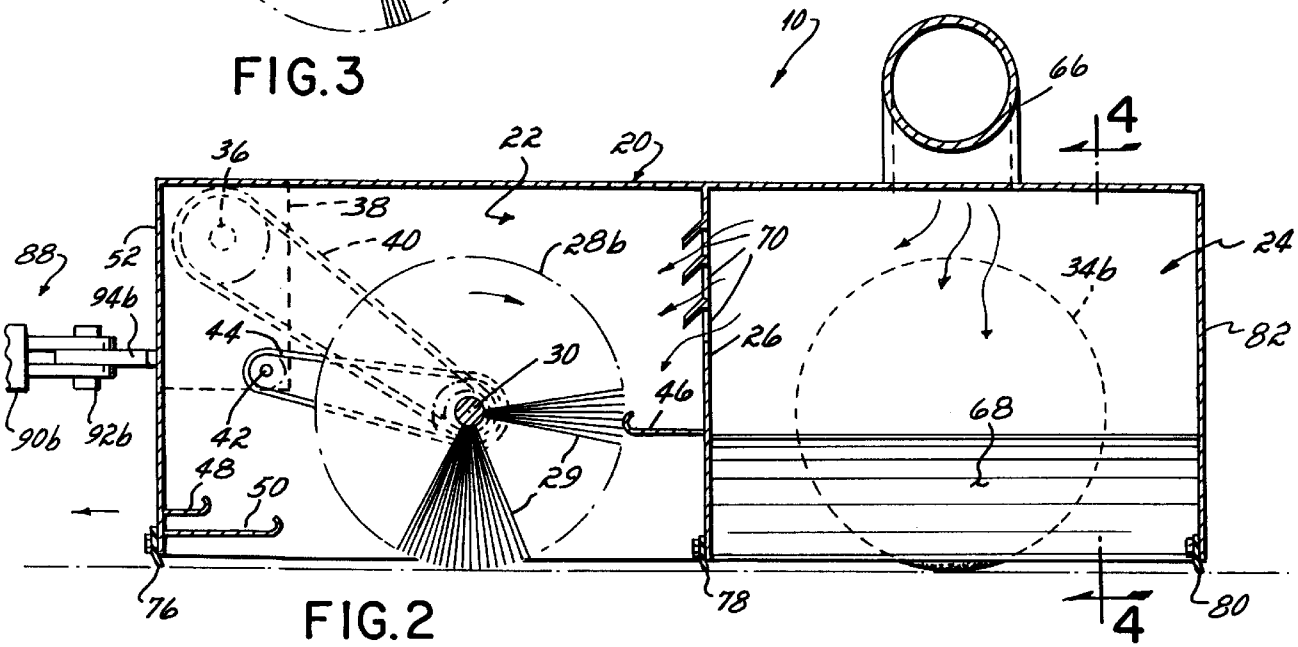
FIG. 2 is an enlarged cross-sectional view of the surface drying machine of FIG. 1 taken along line 2—2.

Referring first to FIGS. 1 and 2, a surface drying machine 10 is shown constructed in accordance with the principles of this invention. Throughout this specification, the term surface refers to any suitable hard surface from which water may need to be removed such as a street, a highway, a raceway, an airport runway or an outdoor tennis or basketball court. The surface drying machine 10 has a rectangular, box-like housing 20. The housing 20 is divided into a first or leading chamber 22 and a second or trailing chamber 24. Throughout this specification the term leading refers to a forward direction as referenced when the surface drying machine 10 is operating, i.e., being towed to remove water from an underlying surface. Likewise the term trailing refers to a rearward direction as referenced when the surface drying machine 10 is operating. The leading chamber 22 and the trailing chamber 24 share a common, internal wall 26 oriented along the long side of the two chambers 22, 24. The housing 20 can be constructed of any suitable structural material, but is preferably made of sheet metal such as stainless steel or aluminum.

Figure 3:
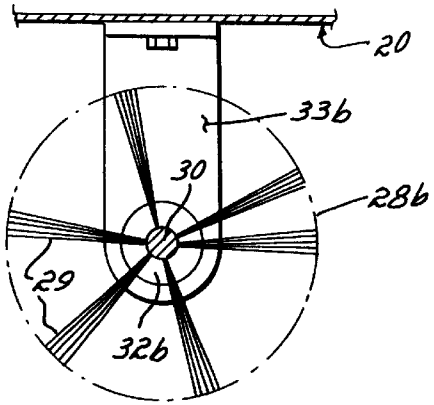
FIG. 3 is an enlarged partial cross-sectional view of the surface drying machine of FIG. 1 taken along line 3—3.

Two brushes 28*a,* 28*b* formed of flexible bristles 29 are mounted for rotation within the leading chamber 22 such that the brushes 28*a,* 28*b* contact the surface over which the surface drying machine 10 is operating. The two brushes 28*a,* 28*b* share a common rotation axis 30 aligned along the longitudinal axis of each brush 28*a,* 28*b.* The rotation axis 30 is perpendicular or transverse to the surface drying machine's 10 direction of travel when towed to remove water from the surface. As shown in FIGS. 2 and 3, the brushes 28*a,* 28*b* rotate within floating bearings 32*a,* 32*b,* 32*c* which are held respectively by support members 33*a,* 33*b,* 33*c* which are suitably affixed to the housing 20. The floating bearings 32*a,* 32*b,* 32*c* enable the brushes 28*a,* 28*b* to follow the contours of the surface so as to maintain contact with the surface when water is being removed. More specifically, the floating bearings 32*a,* 32*b,* 32*c* allow each end of the brushes 28*a,* 28*b* to move independently up or down, thereby allowing the surface drying machine 10 to be effective in removing water even over irregular and uneven surfaces. It will be appreciated that several brushes mounted within floating bearings would provide effective water removal capability over a highly uneven surface. However, for operation over paved raceway surfaces, it is believed that the two brushes 28*a,* 28*b* are sufficient to follow the contours of that surface. Because the brushes 28*a,* 28*b* are in constant contact with the underlying surface, the flexible bristles 29 are preferably formed from material such as plastic that has good wear resistance and is not susceptible to degradation because of extended exposure to water.

An oppositely disposed pair of wheels 34*a,* 34*b* connect to the housing 20 so as to allow the surface drying machine 10 to travel perpendicularly to the longitudinal axis of the brushes 28*a,* 28*b* when the surface drying machine 10 is operating. As the surface drying machine 10 is towed during operation, the rotation of drive wheel 35, which is the front wheel of paired wheels 34*b,* supplies the power to turn brushes 28*a,* 28*b.* More specifically, the drive wheel 35 drivingly engages an input shaft 36 of gearbox 38 via drive chain 40. Furthermore, an output shaft 42 drivingly engages the two brushes 28*a,* 28*b* via drive chain 44. The output shaft 42 is operatively connected to input shaft 36 via gears (not shown) within gearbox 38. The gear ratio of gearbox 38 is such that the two brushes 28*a,* 28*b* rotate faster than the drive wheel 35 traveling over the underlying surface. The gear box 38 is configured such that the brushes 28*a,* 28*b* rotate in a direction opposite to that of the drive wheel 35. It will be appreciated that the brushes 28*a,* 28*b* could be driven by an electric motor or an internal combustion engine, thereby allowing the brushes 28*a,* 28*b* to rotate even when the lead wheel 35 is stationary.

To assist in the collection of water, a drip pan 46 spans the length of the common wall 26 within the leading chamber 22. The drip pan 46 is positioned so that ends of the bristles 29 of the brushes 28*a,* 28*b* contact the drip pan 46 so as to dislodge the collected water in the rotating brushes 28*a,* 28*b* and deposit that water into the drip pan 46. In addition, drip pans 48, 50 span the length of a front wall 52 within leading chamber 22. As the brushes 28*a,* 28*b* rotate and contact the underlying surface, the flexible bristles 29 cause a certain portion of the water on the underlying surface to become air born within the leading chamber 22. The drip pans 48, 50 are positioned so as to collect this air born water propelled in a forward direction by the rotating brushes 28*a,* 28*b*. A collection tank 54 is mounted to the exterior of the housing 20 and is adapted to receive the collected water in each of the three drip pans 46, 48, 50 located in the leading chamber 22. The collection tank 54 includes a drain fitting 56 from which the water in the collection tank 54 can be drained when necessary.

Figure 5:
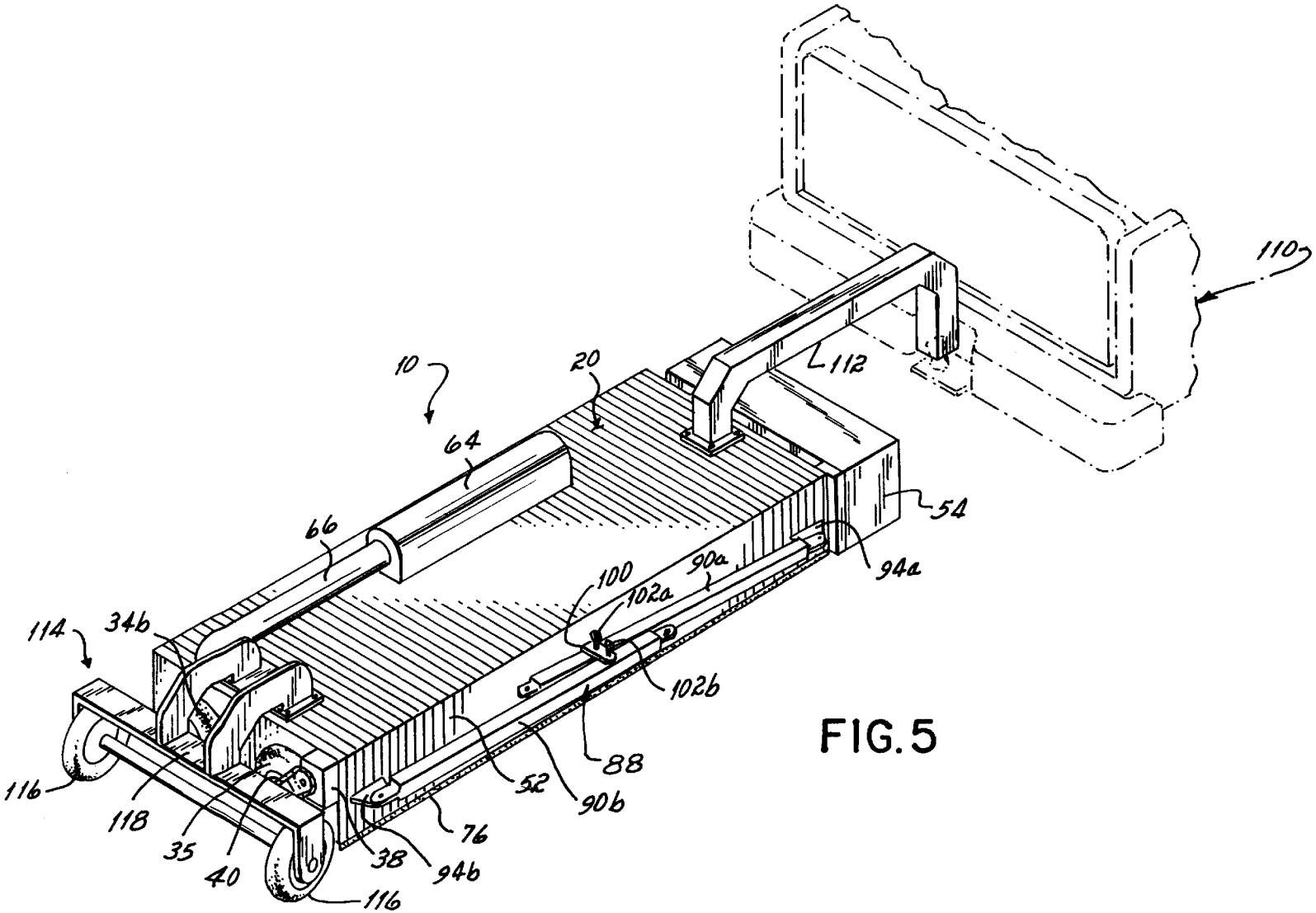
FIG. 5 is a perspective view of the surface drying machine of FIG. 1 shown being transported.

With reference to FIGS. 2 and 5, a blower 64 is mounted atop the housing 20 generally over the trailing chamber 24. The blower 64 can be any suitable blowing device, such as a gas turbine, capable of discharging heated, high-velocity air. One suitable blower 64 is a surplus military jet engine manufactured by Rolls Royce and generating 2800 lbs. of thrust. An upward exhaust outlet (shown in FIG. 6 as 68*a* in phantom) may be provided to exhaust the hot air from jet engine upwardly after the hot air passes over the pavement. An air duct 66 directs the air discharged from the blower 64 into the trailing chamber 24 and onto an arcuate air deflector 68. The air deflector 68 directs the air across the length of the trailing chamber 24. Because the housing 20 has an open bottom, the heated air impinges on the underlying surface. As such, the heated air passing over the underlying surface assists in evaporating the remaining water not already removed by the brushes 28*a,* 28*b*. In addition, the common wall 26 has slots or louvers 70 which divert a portion of the heated air from the trailing chamber 24 into the leading chamber 22 to help evaporate any air born water as well as any water remaining in the brushes 28*a,* 28*b*.

To provide additional means for removing water from a surface, a plurality of squeegees are positioned along the bottom edges of the housing 20. More specifically, squeegees 76, 78, 80 are affixed respectively to the bottom edges of the leading wall 52, the common wall 26, and a rear wall 82 of the trailing chamber 24. The squeegees 76, 78, 80 are mounted so that their free ends contact the underlying surface with sufficient pressure so as to divert water on the underlying surface to one side of the surface drying machine 10. Consequently, the squeegees 76, 78, 80 are formed preferably of a flexible and resilient material with good wear resistance such as rubber. The squeegees 76, 78, 80 may be adjustable relative to the housing 20 so that as the squeegees 76, 78, 80 wear down from the continuous contact with the surface they may be adjusted downwardly to maintain contact with the surface without the need to install new squeegees.

During the operation of the surface drying machine 10, an operation hitch 88 is used to tow the surface drying machine 10 behind another powered vehicle (not shown). The operation hitch 88 is formed from two pivotally mounted tow members 90*a,* 90*b* attached by pins or bolts 92*a,* 92*b* to lugs 94*a,* 94*b*. To form the operation hitch 88, tow members 90*a,* 90*b* are pivoted about pins 92*a,* 92*b* to form a triangle with the front wall 52 acting as the third side. A pin 96 inserted into holes 98*a,* 98*b* on the respective ends of tow members 90*a,* 90*b* connect the operation hitch 88 to a tow vehicle. When the surface drying machine 10 is transported to another location or is stored after use, the operation hitch 88 can be collapsed by removing pin 96 from holes 98*a,* 98*b* and pivoting the tow members 90*a,* 90*b* along side the front wall 52 and into a holding member 100. Removable pins 102*a,* 102*b* are inserted respectively into holes 104*a,* 104*b* located along the length of tow members 90*a,* 90*b* and through holes 106*a,* 106*b* in the holding member 100. Accordingly, the tow members 90*a,* 90*b* are held in place along the front wall 52.

With reference to FIG. 5, the surface drying machine 10 is shown being towed by a tow vehicle 110. In order to cover the most wetted surface in the least amount of time, the surface drying machine 10 is generally wider than, for instance, a full-sized pick-up truck. Consequently, in order to transport the surface drying machine 10 on a roadway from one location to another, the surface drying machine 10 must be towed in a direction parallel to the longitudinal axis of the brushes 28*a,* 28*b*. To allow transport, therefore, a transport hitch 112 is detachably connected to the housing 20. Preferably, the transport hitch 112 is bolted to the housing 20. The free end of the transport hitch 112 preferably has a connector suitable for coupling the transport hitch 112 to a standard ball hitch to allow pivotal motion between the surface drying vehicle 10 and the tow vehicle 110. Generally, when the surface drying machine 10 is in operation the transport hitch 112 will be removed from the housing 20 to decrease the effective operation width of the surface drying machine 10.

A transport dolly 114 is detachably mounted to the opposite side of the housing 20 to which the transport hitch 112 is mounted. Preferably the transport dolly 114 is bolted to the housing 20 to facilitate quick removal of the transport dolly 114. As such, the transport dolly 114 and the transport 112 work in cooperation with one another to allow the surface drying machine 10 to be transported from one location to another. The transport dolly 114 includes a pair of oppositely disposed wheels 116 mounted to frame 118. As can be appreciated, the combination of the transport hitch 112 and the transport dolly 114 must elevate the surface drying machine 10 sufficiently so that any part normally designed to contact the underlying surface during operation no longer touches the surface during transport of the surface drying machine 10.

Figure 6:
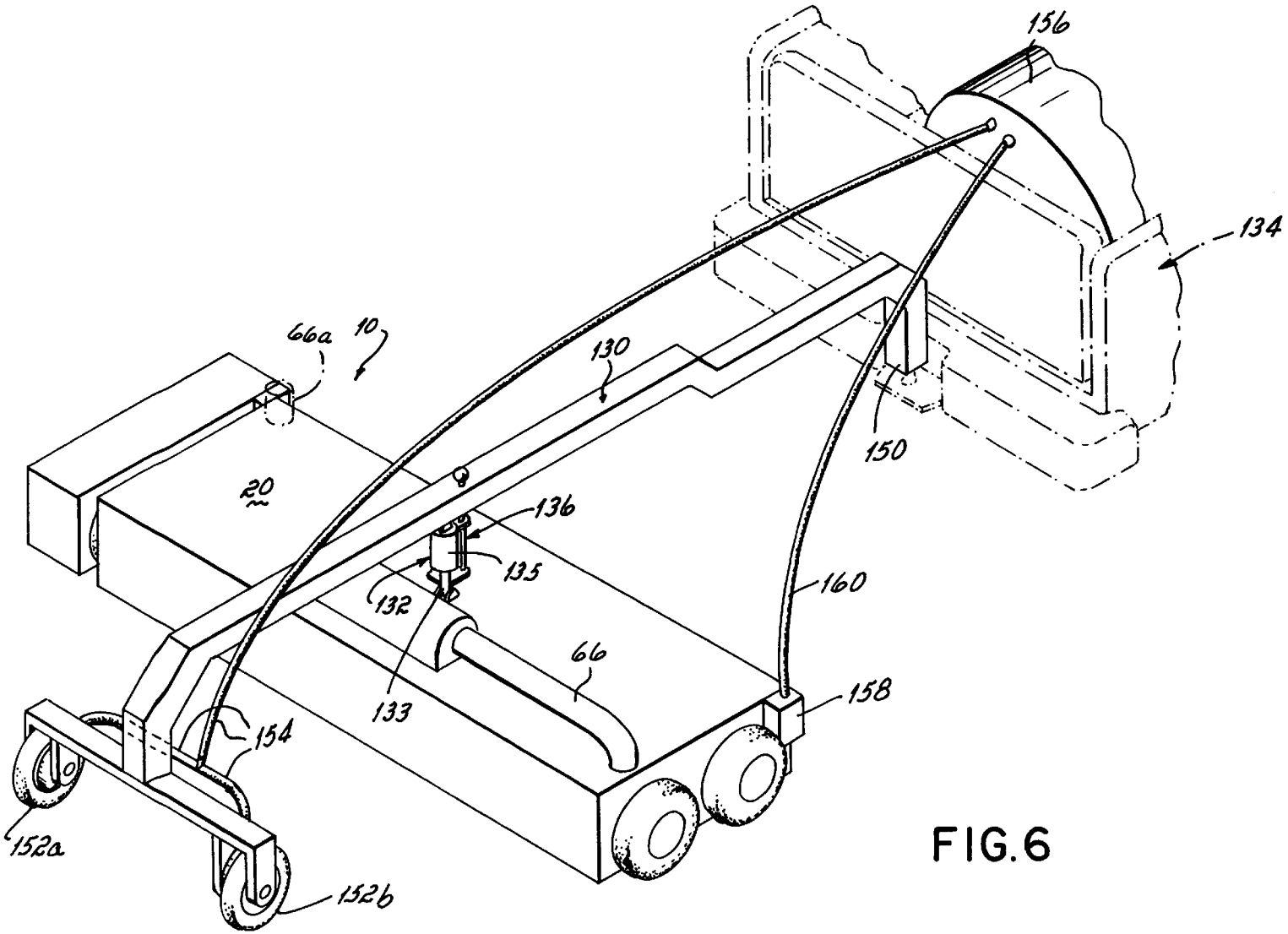
FIG. 6 is a perspective view of the surface drying machine in the operational orientation being towed using an alternate transport hitch.
Figures 7, 7A:
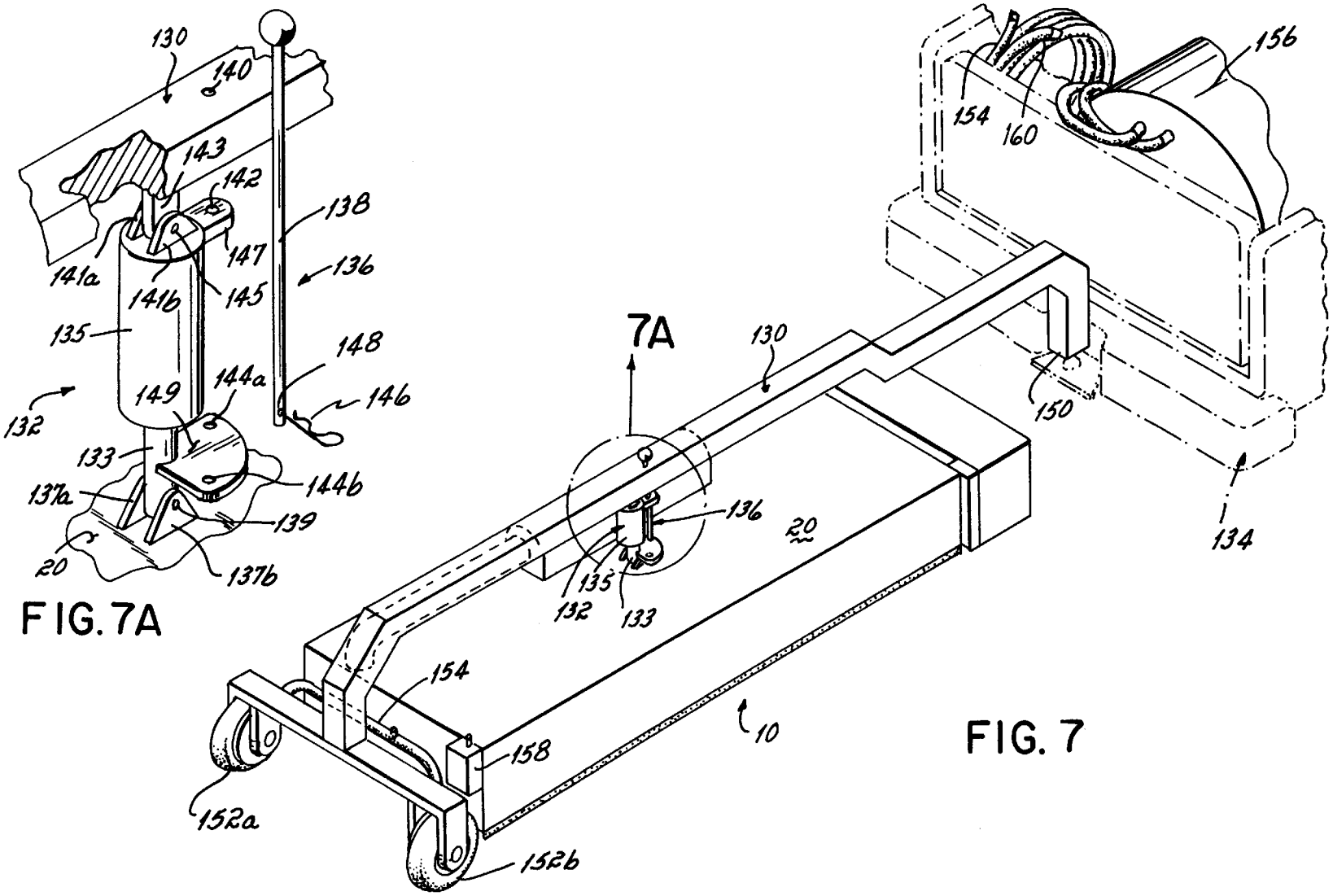
FIG. 7 is a perspective view of the surface drying machine of FIG. 6 in the transport orientation.
FIG. 7A is an enlarged perspective view, of the circled area 7A, of the locking mechanism of the surface drying machine of FIG. 7.

Another towing configuration for towing the surface drying machine 10 of the present invention is illustrated in FIGS. 6 and 7. With this configuration, a single piece transport hitch 130 is pivotally connected to the housing 20 by means of a lift cylinder 132. As such, the surface drying machine 10 can be towed by a vehicle 134 in one of two selectable orientations. As shown in FIG. 7, the first orientation or the travel position orients the surface drying machine 10 so that it is towed in a direction parallel to the rotational axis 30. As shown in FIG. 6, the second orientation or the operational position orients the surface drying machine 10 so that it is towed in a direction perpendicular to the rotational axis 30. Because the transport hitch 130 can tow the surface drying machine 10 in both the travel direction and the operation direction, the operational hitch 88 as shown in FIGS. 1 and 5 can be eliminated when using the transport hitch 130.

The lift cylinder 132 provides a means to lift the surface drying machine 10 off the ground so that it may be rotated to one of the two towing orientations. Once the surface drying machine is rotated to the desired orientation the lift cylinder 132 is locked into place to prevent further rotation. The lift cylinder 132 can be of any suitable design capable of lifting an object of the size and weight of the machine 10. Though the lift cylinder 132 could be manually actuated, it is preferably hydraulically actuated. Lift cylinder 132 includes a piston end 133 and a cylinder end 135. Attachment lugs 137*a,* 137*b* are pinned to piston end 133 with a pin 139 on one end, and on the other end the lugs 137*a,* 137*b* are secured to the housing 20 as by welding or the like. Another set of attachment lugs 141*a,* 141*b* are secured to the cylinder end 135. A tongue 143 is pinned to the attachment lugs 141*a,* 141*b* with a pin 145 on one end of the tongue 143, while the other end of the tongue 143 is secured to the transport hitch 130 as by welding or the like. Rotation of the machine 10 is accomplished by manually (or hydraulically) pivoting the machine 10 about an vertical axis coincident with the vertical axis of the left cylinder 132. During such movement, piston end 133 twists relative to cylinder end 135 by 90°.

The lift cylinder 132 can be locked in place by any conventional locking mechanism. One possible locking mechanism 136 is illustrated in FIG. 7*a*. A lock pin 138 is inserted through hole 140 in the transport hitch 130 and for towing in the traveling position, the locking pin 138 is inserted through a hole 142 in a lug 147 secured to cylinder end 135 of lift cylinder 132 and through a hole 144*a* in a plate 149 secured to piston end 133 of lift cylinder 132. Similarly, for towing in the operational position, the locking pin 138 is inserted respectively through the hole 140, the hole 142 and a hole 144*b* in the plate 149 secured to piston end 133 of lift cylinder 132. A keeper pin 146 is inserted in a hole 148 at the end of locking pin 138 to secure the locking pin 138 in the locking mechanism 136.

One end of the transport hitch 130 includes a coupling device 150 which is suitable for coupling the transport hitch 130 to hitch on vehicle 134, such as a ball hitch or a fifth wheel. The opposite end of the transport hitch 130 has a pair of transport wheels 152*a,* 152*b*. Preferably the transport wheels 152*a,* 152*b* are selectively steerable. A hydraulic hose 154 operably connects to the transport wheels 152*a,* 152*b* to selectively steer them as required. The hydraulic hose 154 may be connected to a hydraulic pump 156 carried on the vehicle 134. As such, the surface drying machine 10 can be operated on highly banked roadway surfaces. That is, the steerable transport wheels 152*a,* 152*b* can be selectively turned to help keep the surface drying machine 10 on the highly banked roadway surface without it sliding or slipping off the roadway surface.

As shown in FIG. 6, a motor 158 is mounted to housing 20. The motor 158 is preferably connected to hydraulic hose 160 from which the motor 29 is powered. The hydraulic hose 160 may be connected to the hydraulic pump 156 carried on the vehicle 134. The motor 158 is operably coupled to brushes 28*a,* 28*b* (FIG. 1) to rotate them when the surface drying machine 10 is removing water from the underlying roadway surface. The motor 158 is a substitute for the drive wheel 35 and gearbox 38 which rotated the brushes 28*a,* 28*b* in the surface drying machine 10 shown in FIGS. 1–5. Because the drive wheel 35 is not used to rotate the brushes 28*a,* 28*b* when motor 158 is used, the brushes 28*a,* 28*b* can rotate even when the surface drying machine 10 is stopped and the wheels 34*a,* 34*b* are not moving. When the surface drying machine 10 is the traveling position, as shown in FIG. 7, a portion of the hydraulic hoses 154, 160 can be disconnected and coiled up for placement in the towing vehicle 134, for example.

In operation, the surface drying machine 10 is towed by another vehicle (not shown) across a wet surface, such as a paved race track. As the surface drying machine 10 begins to move, standing water is diverted to one side of the surface drying machine 10 by squeegee 76. At the same time, the rotation of drive wheel 35 begins to drive brushes 28*a,* 28*c* via gear box 38. The internal gearing is such that the brushes 28*a,* 28*c* rotate in a direction opposite to that of the wheels 34*a,* 34*b*. As such, the flexible bristles 29 of brushes 28*a,* 28*c* flip water from the surface not already diverted by squeegee 76 forwardly for collection in drip pans 48, 50. The water remaining on the bristles 29 is dislodged from the bristles 29 when the bristles 29 strike drip pan 46. The water collected in the respective drip pans 46, 48, 50 is directed to collection tank 54 for storage until the water removal task is completed. If any water remains on the underlying surface, the squeegee 78 will divert it to one side of the surface drying machine 10. To further dry the underlying surface, the blower 64 exhausts heated, high-velocity air into and across trailing chamber 24. A portion of that heated air is directed into the leading chamber 22 through slots 70 in the common wall 26. Finally, if any water remains of the surface, the squeegee 80 on the trailing wall 82 will divert it to one side of the surface drying machine 10. Therefore, the squeegees 76, 78, 80, the rotating brushes 28*a,* 28*b,* and the blower 64 provide a surface drying machine 10 that quickly and efficiently drys water from a surface such as a paved raced track.

While the present invention has been illustrated by a description of a preferred embodiment and while this embodiment has been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art. The invention itself should only be defined by the appended claims, wherein it is claimed:

What is claimed is:

1. An apparatus for traversing a surface to remove water therefrom, the apparatus comprising:

a housing with first and second chambers, said first chamber having a first drip pan for collecting water, said first chamber preceding said second chamber as the apparatus traverses the surface;

at least one brush rotatably mounted in said first chamber, the longitudinal axis of said brush being oriented transversely to the apparatus's direction of travel when removing water, said brush adapted to contact the surface so as to collect water in said brush when said brush rotates;

first and second squeegees mounted respectively to said first and second chambers for diverting water along the surface over which the apparatus is traversing; and a blower for forcing air into said second chamber for aiding evaporation of water on the surface not already collected by said brush.

2. The apparatus of claim 1 further comprising:

a first pair of oppositely disposed wheels operatively connected to said housing for allowing movement of the apparatus perpendicularly to the longitudinal axis of said brush so as to remove water from the surface.

3. The apparatus of claim 2 further comprising:

a second set of wheels operatively connected to said housing and oriented perpendicularly to said first set of wheels such that the apparatus may be transported in a direction parallel to the longitudinal axis of said brush.

4. The apparatus of claim 3 further comprising:

a transport hitch detachably connected to said housing and oriented such that the apparatus may be towed by a vehicle in a direction parallel to the longitudinal axis of said brush when the apparatus is not being used to remove water from the surface.

5. The apparatus of claim 2 wherein at least one of said first pair of wheels is operably coupled to said brush so as to turn said brush when said first pair of wheels turns.

6. The apparatus of claim 2 further comprising:

a transport hitch pivotally connected to said housing so that said housing can be selectively rotated relative to said transport hitch such that the water removal apparatus can be towed in one of two orientations, said first orientation being parallel to the longitudinal axis of said brush, said second orientation being perpendicular to the longitudinal axis of said brush.

7. The apparatus of claim 6 wherein said transport hitch has a pair of transport wheels disposed at a first end of said transport hitch and a coupling device disposed at a second end of said transport hitch, said transport hitch further includes a lift cylinder for lifting said housing and said first pair of wheels off the ground so that said housing can be selectively rotated between said first and second orientations.

8. The apparatus of claim 7 wherein said transport wheels are selectively steerable.

9. The apparatus of claim 1 further comprising:

an operation hitch operatively connected to said housing and oriented such that the apparatus may be pulled by a vehicle in a direction perpendicular to the longitudinal axis of said brush so as to remove water from the surface.

10. The apparatus of claim 1 wherein there are two rotatably mounted brushes in said first chamber, said brushes being aligned along a common longitudinal axis, each of said brushes being mounted in floating bearings such that each brush may follow the contours of the surface so as to maintain contact with the surface when removing water.

11. The apparatus of claim 1 wherein said first chamber has second and third drip pans adapted to collected water made air born by the rotation of said brush.

12. The apparatus of claim 11 further comprising:

a collection tank attached to said housing and adapted to receive water collected by said first, second and third drip pans.

13. The apparatus of claim 1 wherein said blower is adapted to blow heated air.

14. The apparatus of claim 1 wherein said first and second chambers share a common wall, said wall having slots for diverting a portion of the air from said blower into said first chamber to help evaporate air born water and water remaining in said brush.

15. The apparatus of claim 1 wherein said common wall has a third squeegee mounted to divert water along the surface over which the apparatus is traversing.

16. The apparatus of claim 1 wherein said brush is adapted to contact said first drip pan so as to dislodge the collected water in said brush and deposit the water into said drip pan.

17. The apparatus of claim 1 further including a motor operably coupled to said brush so as to turn said brush to remove water from the surface.

18. The apparatus of claim 17 wherein said motor is hydraulically actuated.

19. An apparatus for traversing a surface to remove water therefrom, the apparatus comprising:

housing with first and second chambers, said first chamber having a plurality of drip pans for collecting water, said first chamber preceding said second chamber as the apparatus traverses the surface;

first and second brushes rotatably mounted in said first chamber and aligned along a common longitudinal axis, the longitudinal axis being oriented transversely to the apparatus's direction of travel when removing water, said brushes adapted to contact the surface so as to collect water in said brushes when said brushes rotate, said brushes also adapted to contact one of said drip pans so as to dislodge the collected water in said brushes and deposit the water into said one of said drip pans, the other of said drip pans adapted to collect water made air born by the rotation of said brush;

a collection tank attached to said housing and adapted to receive water collected by said drip pans;

first and second squeegees for diverting water along the surface over which the apparatus is traversing, said first squeegee mounted to a leading wall of said housing, said second squeegee mounted to a trailing wall of said housing; and a blower for forcing heated air into said second chamber for aiding evaporation of water on the surface not already collected by said brush.

20. The apparatus of claim 19 further comprising:

a first pair of oppositely disposed wheels operatively connected to said housing for allowing movement of the apparatus perpendicularly to the longitudinal axis of said brushes so as to remove water from the surface, said first pair of wheels being operably coupled to said first and second brushes so as to turn said first and second brushes when said first pair of wheels turns; and a second set of wheels operatively connected to said housing and oriented perpendicularly to said first set of wheels such that the apparatus may be transported in a direction parallel to the longitudinal axis of said brush.

21. The apparatus of claim 19 further comprising:

a transport hitch detachably connected to said housing and oriented such that the apparatus may be towed by a vehicle in a direction parallel to the longitudinal axis of said brushes when the apparatus is not being used to remove water from the surface; and an operation hitch operatively connected to said housing and oriented such that the apparatus may be pulled by a vehicle in a direction perpendicular to the longitudinal axis of said brush so as to remove water from the surface.

22. The apparatus of claim 19 further comprising:

a first pair of oppositely disposed wheels operatively connected to said housing for allowing movement of the apparatus perpendicularly to the longitudinal axis of said brushes so as to remove water from the surface;

a transport hitch pivotally connected to said housing so that said housing can be selectively rotated relative to said transport hitch such that the water removal apparatus can be towed in one of two orientations, said first orientation being parallel to the longitudinal axis of said brush, said second orientation being perpendicular to the longitudinal axis of said brush; and a hydraulically actuated motor operably coupled to said first and second brushes so as to turn said first and second brushes to remove water from the surface.

23. The apparatus of claim 22 wherein said transport hitch has a pair of selectively steerable transport wheels disposed at a first end of said transport hitch and a coupling device disposed at a second end of said transport, said transport hitch further includes a lift cylinder for lifting said housing and said first pair of wheels off the ground so that said housing can be selectively rotated between said first and second orientations.

* * * * *

UNITED STATES PATENT AND TRADEMARK OFFICE

CERTIFICATE OF CORRECTION

PATENT NO. : 6,189,179 B1
DATED : February 20, 2001
INVENTOR(S) : Billy Carr Baird It is certified that error appears in the above-identified patent and that said Letters Patent is hereby corrected as shown below:

Column 9,
Line 62, "housing with" should be -- a housing with --.

Signed and Sealed this

Fifth Day of April, 2005

JON W. DUDAS
*Director of the United States Patent and Trademark Office*